US005876032A

United States Patent [19]

Kato

[11] Patent Number: 5,876,032

[45] Date of Patent: Mar. 2, 1999

[54] SHEET FEEDER AND PRINTER

[75] Inventor: Hiroyuki Kato, Nagoya, Japan

[73] Assignee: Brother Kogyo Kabushiki Kaisha, Nagoya, Japan

[21] Appl. No.: 917,600

[22] Filed: Aug. 26, 1997

[30] Foreign Application Priority Data

Aug. 26, 1996 [JP] Japan ..... 8-244209

[51] Int. Cl.[6] ..... B65H 3/06

[52] U.S. Cl. ..... 271/114; 271/115; 271/116; 271/119

[58] Field of Search ..... 271/114, 115, 271/116, 119

[56] References Cited

U.S. PATENT DOCUMENTS

| | | | |
|---|---|---|---|
| 3,762,701 | 10/1973 | Hannon et al. | 271/115 |
| 4,798,374 | 1/1989 | Ito | 271/114 |
| 5,051,014 | 9/1991 | Takagi et al. | 271/116 |
| 5,222,724 | 6/1993 | Hirano et al. | 271/114 |
| 5,480,132 | 1/1996 | Kiyohara et al. | 271/114 |
| 5,540,423 | 7/1996 | Nakano | 271/114 |
| 5,697,603 | 12/1997 | Kato | 271/114 |
| 5,711,519 | 1/1998 | Bortolotti | 271/116 |

FOREIGN PATENT DOCUMENTS

| | | | |
|---|---|---|---|
| 0231322 | 9/1990 | Japan | 271/114 |
| 93637481 | 3/1993 | Japan | 271/114 |
| 405186072A | 7/1993 | Japan | 271/114 |
| 93230303 | 9/1993 | Japan | 271/114 |

*Primary Examiner*—H. Grant Skaggs
*Assistant Examiner*—Wonki Park
*Attorney, Agent, or Firm*—Oliff & Berridge, PLC

[57] ABSTRACT

The sheet feeder of an ink jet printer includes a semi-cylindrical feed roller. A first gear and a second gear are fixed to the roller coaxially with it. The feeder also includes a feed motor rotatable in both directions. The torque of reverse rotation and the torque of normal rotation of the motor are transmitted through a first gear system and a second gear system to the first and second gears, respectively. The first gear has a peripheral surface without teeth. The surface is formed in part of a different peripheral portion of the first gear than the peripheral portion of the first gear which engages with the first gear system while the reverse rotation of the motor by a predetermined amount of reverse rotation is turning the roller by a first predetermined amount from an initial position. Even if the roller has turned from another position than the initial position, it can return to the initial position during the reverse rotation of the motor, because the peripheral surface of the first gear prevents the driving force of the first gear system from being transmitted to this gear.

25 Claims, 10 Drawing Sheets

SHEET FEEDER AND PRINTER

FIELD OF THE INVENTION

The present invention relates to a sheet feeder and a printer. In particular, the invention relates to a sheet feeder and a printer including feed rollers which can be returned to their initial position by the feeding operation being carried out once even if the rollers are out of the initial position.

BACKGROUND OF THE INVENTION

An ink jet printer or another conventional printer includes a sheet feeder, a sheet conveyer, a print unit and a sheet discharger. The feeder includes a sheet support. The print unit includes a print head. The feeder can feed one after one the sheets of paper stacked on the support. The conveyer can convey the fed sheet toward the print head. The print unit can print the conveyed sheet. The discharger can discharge the printed sheet from the printer. The feeder also includes feed rollers for rotation in frictional contact with the top one of the sheets stacked on the support. The feeder further includes a drive for rotating these feed rollers. The conveyer includes a feed roller which can be rotated by the drive. The conveyer also includes a pressure roller in rotatable compressive contact with the conveyer feed roller.

In order for the top one of the sheets stacked on the support to be fed by the feeder and conveyed by the conveyer toward the print head, the drive first rotates the feeder feed rollers in the normal direction to feed the top sheet toward the conveyer. At the same time, the drive rotates the conveyer feed roller reversely to stop the front end of the fed sheet temporarily between the conveyer feed roller and the pressure rollers. Then, the conveyer feed roller is rotated normally, with the feeder feed rollers rotated normally, to convey the sheet toward the print head.

When the feeder feeds a sheet of paper toward the conveyer, the conveyer feed roller is rotated reversely to stop the front end of the sheet temporarily, as stated above, in order to warp or curl the sheet between the feeder and the conveyer. With the sheet warped, the position and direction of its front end are adjusted securely with respect to the conveyer feed roller. Thereafter, in accordance with the amount of normal rotation of the conveyer feed roller, the feed from this roller toward the print head is controlled precisely. Therefore, in this type of drive, the feeder feed rollers can be rotated normally and the conveyer feed roller can be rotated reversely at the same time. Besides, the feeder feed rollers and conveyer feed roller can be rotated normally at the same time.

FIGS. 14 through 16 show the drive for an ink jet printer which is disclosed by the assignee of the present application in U.S. patent application Ser. No. 08/769,277. The printer includes semi-cylindrical feed rollers 101 and another feed roller 104. The drive 100 includes a feed motor 107, which can rotate a feed gear 105 normally and reversely through a reduction gear 106. The feed gear 105 is fixed to one end of the shaft to which the feed roller 104 is fixed. The feed gear 105 is in mesh with a sun gear 110, which is fixed to a pin. A first carrier arm 111 and a second carrier arm 115 are supported pivotably on the pin. A first planet gear 112 is supported rotatably on the free end of the first arm 111, and in mesh with the sun gear 110. The first planet gear 112 can mesh with an intermediate gear 113, which is in mesh with a first gear 102. A second planet gear 116 is supported rotatably on the free end of the second arm 115, and in mesh with the sun gear 110. The second planet gear 116 is urged toward a second gear 103 by a spring 115*a*, and can mesh with the second gear 103. The first gear 102 and second gear 103 are fixed to one end of the shaft to which the feed rollers 101 are fixed. The second gear 103 is a partial gear having a cylindrical or peripheral surface 103*a* without teeth. The diameter of the surface 103*a* is smaller than the outer diameter of the second gear 103. In order to feed a sheet of paper, a controller makes the motor 107 rotate reversely by a first predetermined amount and, thereafter, normally by a second predetermined amount.

When the feed rollers 101 are at their initial position shown in FIG. 14, reverse rotation of the feed motor 107 in the direction "a" rotates the feed gear 105 reversely in the direction "c" together with the feed roller 104. This moves the first planet gear 112 into engagement with the intermediate gear 113. As a result, the first gear 102 rotates together with the feed rollers 101 normally in the direction indicated in FIG. 14. The reverse rotation of the motor 107 by the first predetermined amount feeds toward the sheet conveyer the top one of the sheets stacked on the sheet support. While the motor 107 is rotating reversely by the first amount, the second planet gear 116 faces the peripheral surface 103*a* of the second gear 103. At the end of the reverse rotation by the first amount, the leading tooth of the second gear 103 comes in contact with the second planet gear 116, but the second gear 103 does not mesh with this planet gear 116 because these gears are rotating in the same direction.

Subsequently, normal rotation of the feed motor 107 in the direction "b" rotates the feed gear 105 normally in the direction "d" together with the feed roller 104. This moves the first planet gear 112 from the intermediate gear 113. At the same time, the second planet gear 116 meshes with the second gear 103. This rotates, through the sun gear 110 and second planet gear 116, the second gear 103 together with the feed rollers 101 normally in the indicated direction. When the motor 107 has rotated normally by the second predetermined amount, the peripheral surface 103*a* of the second gear 103 faces the second planet gear 116. As a result, this planet gear 116 disengages from the teeth of the second gear 103. Consequently, the feed rollers 101 stop at their initial position, while only the feed roller 104 is feeding the sheet.

By the way, the semi-cylindrical feed rollers 101 may be away from their initial position by having been turned by one's finger or sheets of paper touching one or more of these rollers when the sheets were supplied to the feeder, or by other cause. In this case, even when the feed motor 107 has rotated by the first amount as stated above, it is impossible to feed the top sheet by the amount corresponding to the amount of turning of the feed rollers 101. Irrespective of the initial position of the feed rollers 101, the motor 107 rotates reversely by the first amount and normally by the second amount continuously. Therefore, sometimes, it is impossible to return the feed rollers 101 to their initial position. In this case, not only the first, but also the second sheet is fed defectively. It is, however, difficult to confirm from the outside if the feed rollers 101 are out of their initial position. It is also difficult to return the rollers 101 manually with precision to the initial position.

SUMMARY OF THE INVENTION

The object of the present invention is to provide a sheet feeder which is able to return the semi-cylindrical feed roller to the initial position by carrying out the feeding operation once even if the roller has started to operate when it was out of the initial position. The another object of the present invention is to provide a printer including the sheet feeder.

In accordance with a first aspect of the invention, a sheet feeder is provided which comprises:

a sheet support for supporting sheets of paper;

a semi-cylindrical feed roller for feeding a sheet of paper by turning with the cylindrical surface of the roller in contact with the top one of the sheets of paper stacked on the sheet support;

a first gear fixed to an end of the feed roller;

a second gear fixed to an end of the feed roller;

a feed motor which can rotate in both directions to drive the first and second gears;

a first gear system for transmitting the torque of reverse rotation of the feed motor as normal driving force to the first gear;

a second gear system for transmitting the torque of normal rotation of the feed motor as normal driving force to the second gear; and a controller for controlling the feed motor so as to rotate the motor reversely by a predetermined amount of reverse rotation and, thereafter, normally by a predetermined amount of normal rotation when the feed roller feeds a sheet of paper.

The first gear has a peripheral surface without teeth. The surface is formed in at least part of a different peripheral portion of the first gear from the peripheral portion of the first gear which engages with the first gear system while the reverse rotation of the feed motor by the predetermined amount of reverse rotation is turning the feed roller by a first predetermined amount from an initial position.

When the feed roller is at its predetermined initial position, which may be a position where the cylindrical surface of the roller is away from the sheet support, the roller is out of contact with the top one of the sheets stacked on the support. Under this condition, when the controller first makes the feed motor rotate reversely by the predetermined amount of reverse rotation, the torque of reverse rotation of the motor is transmitted as the normal driving force through the first gear system to the first gear. As a result, the roller turns normally together with the first gear. During the reverse rotation of the motor, the peripheral surface of the first gear does not face the first system, and therefore the roller turns normally by the first predetermined amount, which corresponds to the predetermined amount of reverse rotation of the motor. Then, the controller changes the direction of rotation of the motor. The torque of normal rotation of the motor is transmitted as the normal driving force through the second gear system to the second gear. While the motor rotates normally by the predetermined amount of normal rotation, the roller turns normally by the second predetermined amount together with the second gear, and then returns to the initial position.

If the feed roller is positioned off the initial position by having been touched by one's finger or sheets of paper, it can be returned to the predetermined initial position by the following operation.

When the feed roller is positioned out of the initial position, the reverse rotation of the feed motor by the predetermined amount of reverse rotation under the control of the controller transmits the torque of reverse rotation of the motor as the normal driving force through the first gear system to the first gear. If the peripheral surface without teeth in of the first gear faces the first system while the motor is rotating reversely by this amount, no normal driving force can be transmitted through the first system to the first gear, and therefore the roller stops turning. Then, the controller changes the direction of rotation of the motor. The torque of normal rotation of the motor is transmitted as the normal driving force through the second gear system to the second gear. When the motor rotates normally by the predetermined amount of normal rotation, the roller turns normally together with the second gear, and then returns to the initial position.

As stated above, the first gear has a peripheral surface without teeth. The surface is formed in at least part of a different peripheral portion of the first gear from the peripheral portion of the first gear which engages with the first gear system while the reverse rotation of the feed motor by the predetermined amount of reverse rotation is turning the feed roller by a first predetermined amount from an initial position. The peripheral surface of the first gear can be formed in such a position on the periphery of this gear that, when the roller has started to turn from another position than the initial position, this surface can face the first gear system during the predetermined reverse rotation of the motor, and the roller can return to the initial position during or after the predetermined normal rotation of the motor. The peripheral surface makes it possible to return securely to the predetermined initial position the roller which has started to turn from any position, by carrying out the feeding operation once, that is to say, rotating the motor reversely by the predetermined amount of reverse rotation and then normally by the predetermined amount of normal rotation. The second and succeeding sheets can be fed ordinarily.

The sheet feeder may further comprise a second feed roller, which can rotate in the direction according to the direction of rotation of the feed motor. The controller controls the feeder in such a manner that the reverse rotation of the motor by the predetermined amount of reverse rotation turns, through the first gear, the semi-cylindrical feed roller by the first predetermined amount from the initial position, and then the normal rotation of the motor by the predetermined amount of normal rotation turns, through the second gear, the semi-cylindrical roller by the second predetermined amount, so as to feed a sheet of paper. This operation is carried out to make the reversely rotating second roller temporarily stop and position or register the front end of the sheet fed by the semi-cylindrical roller, and then to control, in accordance with the amount of normal turning of the second roller, the amount of conveyance of the sheet to the downstream side of the second roller.

The first gear system may include a sun gear and a first arm which is supported pivotably on the axis coaxial with the sun gear. The first arm can be turned in the same direction as the sun gear rotates. The first system may also include a first planet gear supported rotatably on the free end of the first arm, and meshing with the sun gear. The first system may further include an intermediate gear which can mesh with the first gear and the first planet gear. The second gear system may include the sun gear and a second arm which is supported pivotably on the axis coaxial with the sun gear. The second arm can be turned in the same direction as the sun gear rotates. The second system may also include a second planet gear supported rotatably on the free end of the second arm, and meshing with the sun gear. The second planet gear can mesh with the second gear. Such gear systems are simple in structure, and the costs for manufacturing them can be low.

The second gear may have a peripheral surface without teeth. This surface is formed in the peripheral portion of the second gear which faces the second gear system when the semi-cylindrical feed roller is at the initial position. This peripheral surface the second gear system from engagement during or after the normal rotation of the feed motor by the predetermined amount of normal rotation. It may be possible to release the second system from engagement by disengaging the second planet gear and the second gear from each other. Accordingly, no driving force can be transmitted through the second system to the second gear. As a result, the semi-cylindrical roller can be returned securely to the initial position.

The peripheral surface of the second gear may be formed over the peripheral portion of this gear which faces the second gear system while the semi-cylindrical feed roller is turning by the first predetermined amount from the initial position.

If the semi-cylindrical feed roller has started to turn from a different position from the initial position, the peripheral surface of the first gear may not face the first gear system during the reverse rotation of the feed motor by the predetermined amount of reverse rotation, due to the different starting position, the predetermined amount of reverse rotation, the circumferential length of the peripheral surface of the first gear, and/or the like. Even in such a case, the semi-cylindrical roller can be returned to the initial position by the peripheral surface of the second gear facing the second gear system during the normal rotation of the motor by the predetermined amount of normal rotation.

The peripheral surfaces of the first and second gears may have such positional relationship to each other that teeth which can always engage with the first or second gear system exist in at least one of the peripheral portions of the first and second gears which face the first and second gear systems, respectively. This relationship is determined by the positions where the first and second systems are set with respect to the first and second gears, respectively, which are coaxial with the semi-cylindrical feed roller.

In accordance with a second aspect of the invention, a printer is provided which comprises a sheet feeder and a print head for printing a sheet of paper. The feeder includes:

- a sheet support for supporting sheets of paper;
- a semi-cylindrical feed roller for feeding a sheet of paper by turning with the cylindrical surface of the roller in contact with the top one of the sheets of paper stacked on the sheet support;
- a first gear fixed to an end of the feed roller;
- a second gear fixed to an end of the feed roller;
- a feed motor which can rotate in both directions to drive the first and second gears;
- a first gear system for transmitting the torque of reverse rotation of the feed motor as normal driving force to the first gear;
- a second gear system for transmitting the torque of normal rotation of the feed motor as normal driving force to the second gear; and
- a controller for controlling the feed motor so as to rotate the motor reversely by a predetermined amount of reverse rotation and, thereafter, normally by a predetermined amount of normal rotation when the feed roller feeds a sheet of paper.

The first gear has a peripheral surface without teeth. This surface is formed in at least part of a different peripheral portion of the first gear from the peripheral portion of the first gear which engages with the first gear system while the reverse rotation of the feed motor by the predetermined amount of reverse rotation is turning the feed roller by a first predetermined amount from an initial position.

A sheet feeder according to the first aspect of the invention is very suitable for a printer including a print head downstream from the feeder.

The print head may be an ink jet head.

BRIEF DESCRIPTION OF THE DRAWINGS

A preferred embodiment of the present invention is shown in the accompanying drawings, in which.

DETAILED DESCRIPTION OF THE EMBODIMENT

An ink jet printer provided with a sheet feeder according to the invention will be described below by using the drawings.

Figure 1:
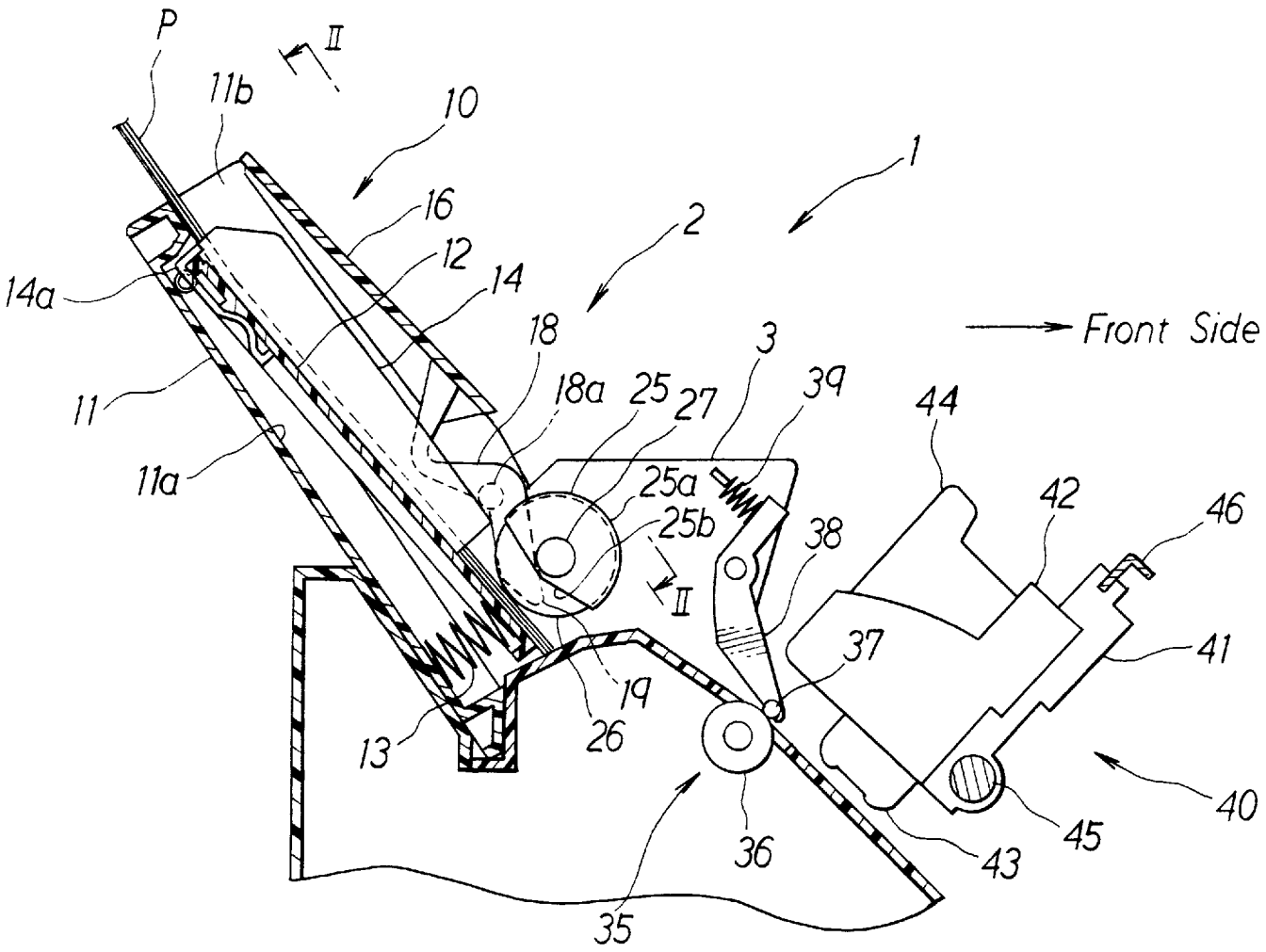
FIG. 1 is a cross section of an ink jet printer according to the embodiment.

As shown in FIG. 1, an ink jet printer 1 includes a print unit 40, which includes a print head 43. A sheet feeder 2 includes a sheet support 12, and can feed one after one the sheets of paper P stacked on the support 12. A sheet conveyer 35 conveys toward the head 43 the sheet fed by the sheet feeder 2. The head 43 ejects ink onto the conveyed sheet. A sheet discharger (not shown) discharges the printed sheet out of the printer 1.

Figure 2:
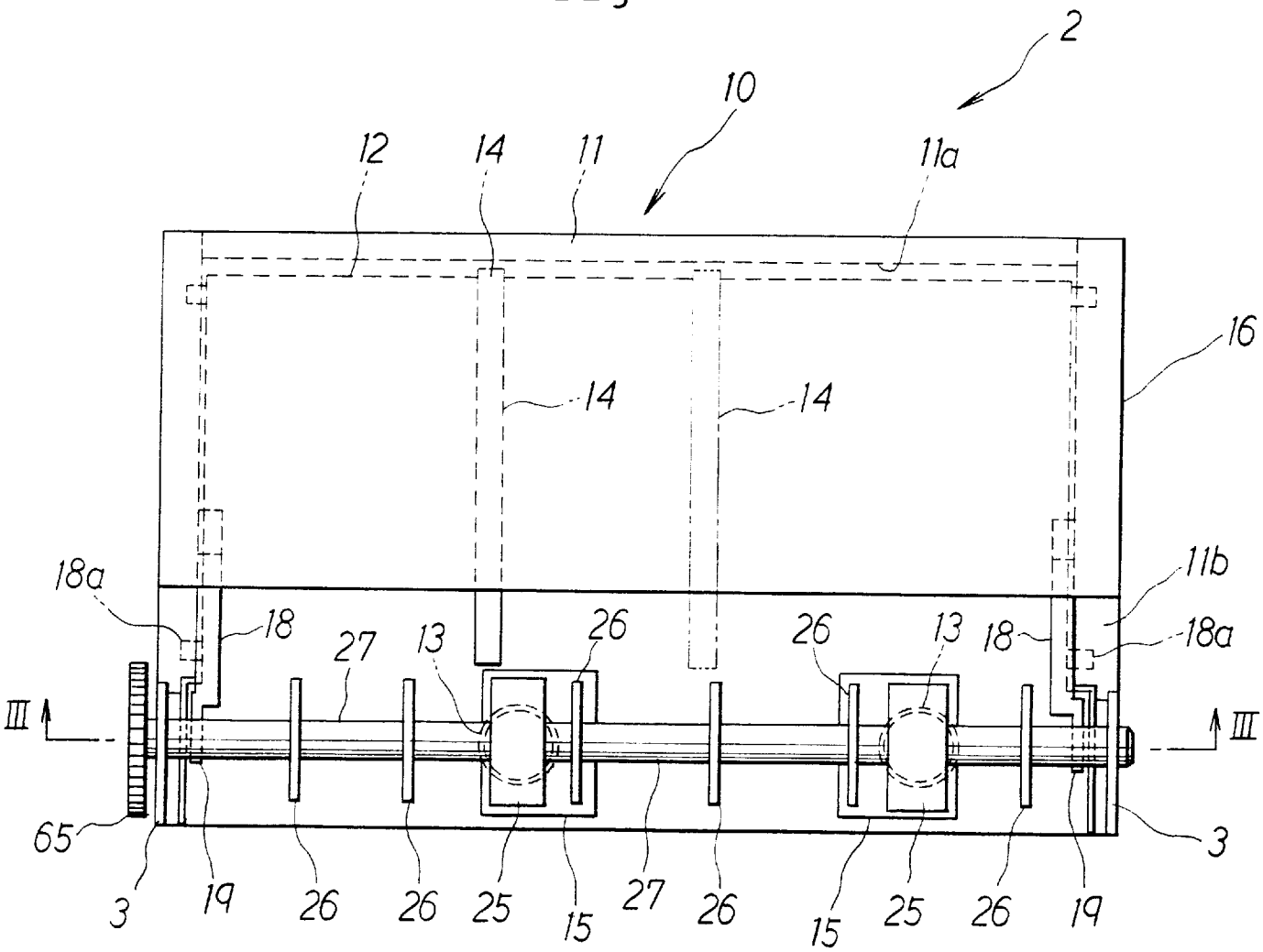
FIG. 2 is a view taken from line II—II of FIG. 1.
Figure 3:
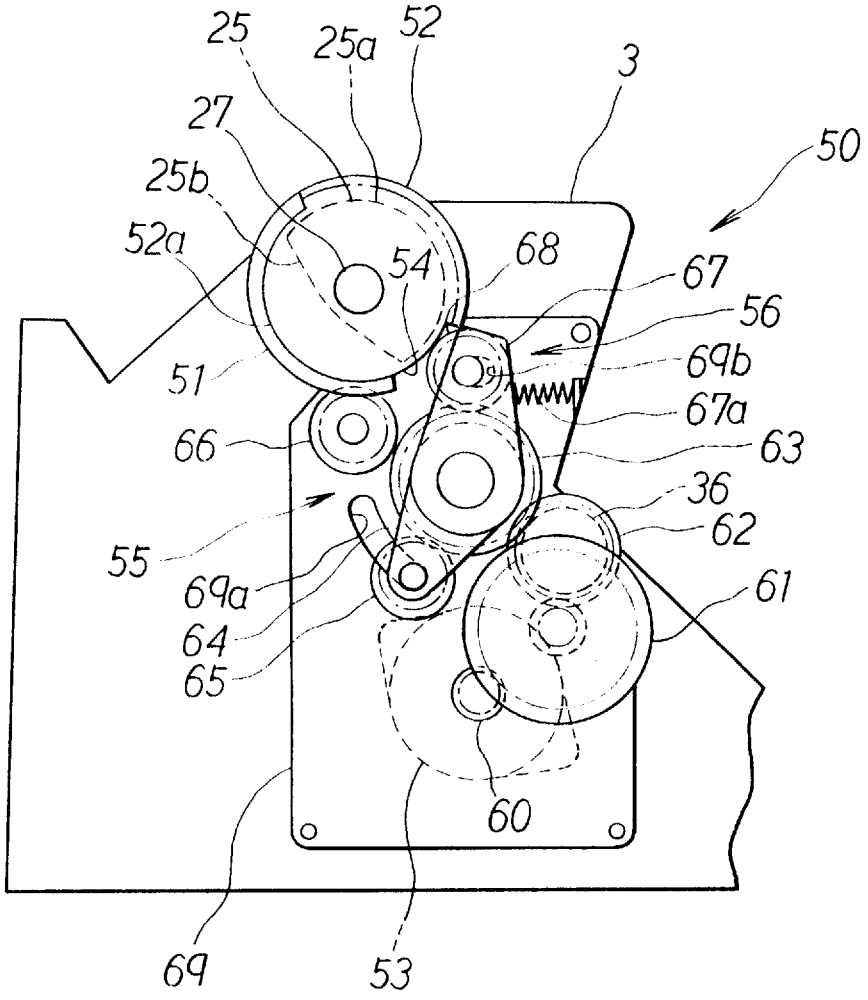
FIG. 3 is an enlarged side view of a drive of the printer.

Structure and components of the sheet feeder 2 will be explained below. As shown in FIGS. 1 and 2, the sheet feeder 2 includes a sheet cassette 10, in which sheets of paper P can be stacked. A horizontal shaft 27 is supported at both its ends rotatably by both side plates 3 of the printer body. Semi-cylindrical feed rollers 25, which may be two in number, are fixed to the shaft 27. Collars 26, which may be six in number, are supported rotatably on the shaft 27. The collars 26 are smaller slightly in diameter than the rollers 25. The rollers 25 can be rotated through the shaft 27 by a drive 50 (FIG. 3). The drive 50 is included by both feeder 2 and conveyer 35.

The sheet cassette 10 includes a body 11 having a pair of side plates 11*b*. Defined between the plates 11*b* is a housing space 11*a*, which houses the sheet support 12. The support 12 is connected at its top pivotably through horizontal pins to the cassette body 11.

The sheet cassette 10 also includes an edge guide 14 supported horizontally movably on the sheet support 12 so as to guide the edges on one side of the sheets P stacked on the support 12. The guide 14 includes a clip 14*a* clipping a top portion of the support 12 so as to fix the guide 14 at any position along the sheet width.

The sheet cassette 10 is fitted with a pair of right and left compression springs 13 in the housing space 11*a* so as to urge the bottom of the sheet support 12 toward the feed rollers 25.

The sheet support 12 is covered with a cover 16, which is connected to the cassette body 11 through a pair of arms 18 in such a manner that it can be opened and closed. Each arm 18 includes a horizontal pin 18*a* formed nearly in its middle, which is supported rotatably on one of the side plates 11*b* of the cassette body 11. One end of each arm 18 is fixed to the back of the cover 16. Each arm 18 also includes a pusher 19 formed at its other end for pushing the sheet support 12.

The sheet support 12 includes friction areas 15, which are higher in friction than the other area, and each of which faces one of the feed rollers 25.

When, as shown in FIG. 1, the cover 16 is closed and the cylindrical surfaces 25*a* of the feed rollers 25 are positioned away from the sheet support 12, the collars 26 are in compressive contact with the top one of the sheets P stacked on the support 12. When the rollers 25 rotate, with the cover 16 closed, the frictional contact between the top sheet P and cylindrical surfaces 25*a* feeds this sheet toward the sheet conveyer 35.

When the cover 16 opens (not shown), the pushers 19 of the arms 18 cause the sheet support 12 to pivot away from the feed rollers 25 against the urging force of the springs 13. Then, sheets of paper P can be set on the support 12.

Structure and components of the sheet conveyer 35 will be explained below. The sheet conveyer 35 includes the drive 50 (FIG. 3), which can drive a feed roller 36 (FIGS. 1 and 3). The feed roller 36 is fixed to a horizontal shaft, which is supported rotatably by the side plates 3. As shown in FIG. 1, arms 38 are supported above the path of conveyance swingably through a horizontal shaft by the side plates 3. Pressure rollers 37 are supported rotatably on one end of each arm 38. The other end of each arm 38 is urged by a compression spring 39 so that the pressure rollers 37 contact compressively with the feed roller 36. In order to register the front end of the sheet P fed by the sheet feeder 2, the feed roller 36 is rotated reversely by the drive 50. Thereafter, the feed roller 36 is rotated normally to convey the sheet P between the feed roller 36 and pressure rollers 37 toward the print head 43.

Structure and components of the print unit 40 will be explained below. As shown in FIG. 1, the print unit 40 includes a carriage 41 supported slidably on and along a horizontal guide rod 45 and a horizontal guide rail 46, which are fixed to the side plates 3 of the printer 1. The carriage 41 can be moved horizontally by a carriage drive (not shown). The carriage 41 supports a holder 42 fixed to it. The holder 42 holds the print head 43 on its rear end. The head 43 is supplied with ink from an ink cartridge 44, which is mounted removably on the holder 42. The head 43 is of the ink jet type for ejecting ink onto a sheet of paper.

Figure 4:
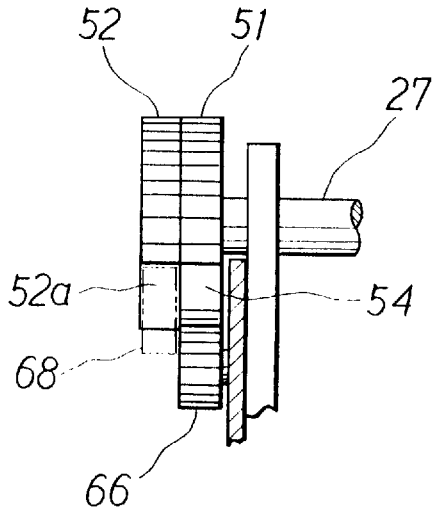
FIG. 4 is an enlarged partial view of the drive.
Figure 5:
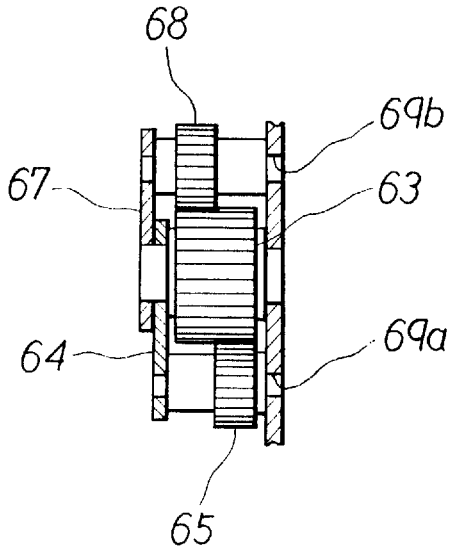
FIG. 5 is another enlarged partial view of the drive.

Structure and components of the drive 50 will be explained below. As shown in FIGS. 3 through 5, the drive 50 includes a first gear 51 and a second gear 52, which are fixed to one end of the shaft 27. The gears 51 and 52 can be rotated by a feed motor 53 for rotation in both directions. The reverse-rotation torque of the motor 53 can be transmitted as normal-rotation driving force through a first gear train 55 to the first gear 51. The torque of normal rotation of the motor 53 can be transmitted as normal-rotation driving force through a second gear train 56 to the second gear 52. In order to feed each sheet of paper P, a sheet feed control (not shown) drives the motor 53 reversely by a first predetermined amount and, thereafter, normally by a second predetermined amount.

The first gear system 55 includes a motor gear 60, a reduction gear 61, a feed gear 62, a sun gear 63, a first carrier arm 64, a first planet gear 65 and an intermediate gear 66. The motor gear 60 is fixed to the drive shaft of the feed motor 53. The reduction gear 61 includes a large-diameter part meshing with the motor gear 60 and a small-diameter part meshing with the feed gear 62. The feed gear 62 is fixed to one end of the shaft to which the feed roller 36 is fixed. The feed gear 62 is also in mesh with the sun gear 63. The carrier arm 64 is supported pivotably at its one end on the axis coaxial with the sun gear 63, and can be turned on this axis by friction transmission in the same direction as the sun gear 63 rotates. The planet gear 65 is supported rotatably on the free end of the carrier arm 64, and in mesh with the sun gear 63. The planet gear 65 can mesh with the intermediate gear 66, which can mesh with the first gear 51.

The second gear system 56 includes the motor gear 60, the reduction gear 61, the feed gear 62, the sun gear 63, a second carrier arm 67 and a second planet gear 68. The carrier arm 67 is supported pivotably at its one end on the axis coaxial with the sun gear 63, and can be turned on this axis by friction transmission in the same direction as the sun gear 63 rotates. The planet gear 68 is supported rotatably on the free end of the carrier arm 67, and in mesh with the sun gear 63. The planet gear 68 can mesh with the second gear 52.

The motor gear 60, reduction gear 61, feed gear 62, sun gear 63 and intermediate gear 66 are supported immovably by a vertical board 69, which is fixed to the printer body. The board 69 has an arcuate slot 69*a* and a short slot 69*b* which are formed through it. One end of the first planet gear 65 is supported slidably in the arcuate slot 69*a* in such a manner that this gear 65 can engage with and disengage from the intermediate gear 66. One end of the second planet gear 68 is supported slidably in the short slot 69*b*. The second planet gear 68 is urged toward the second gear 52 through the second carrier arm 67 by a compression spring 67*a*.

Figure 6:
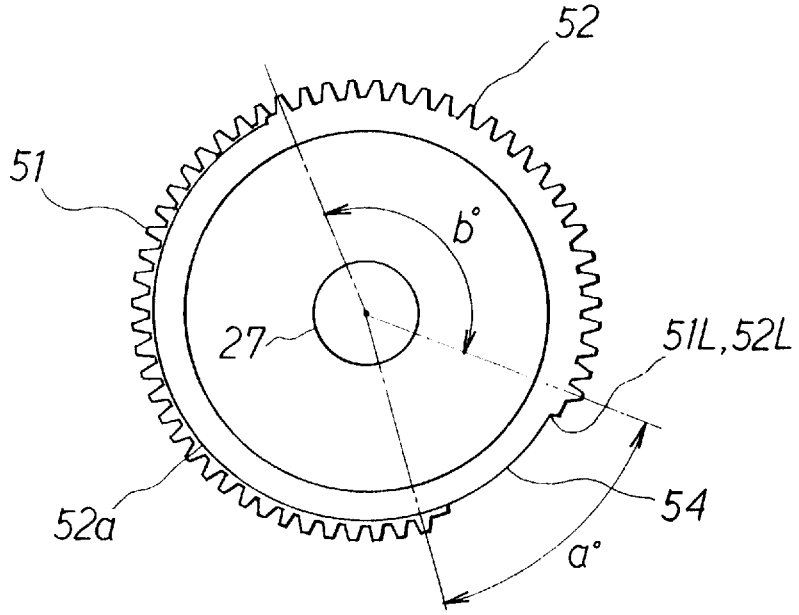
FIG. 6 is enlarged end views of the first and second gears of the drive.
Figure 7:
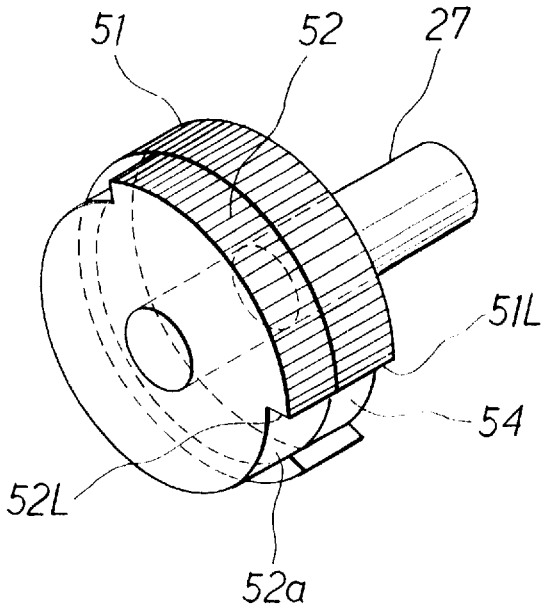
FIG. 7 is perspective views of the parts shown in FIG. 6.

As shown in FIGS. 6 and 7, the first gear 51 has a cylindrical or peripheral surface 54 over a predetermined angle "a", which may be 50 degrees. The peripheral surface 54 has no tooth, and its diameter is smaller than the outer diameter of the first gear 51. When the peripheral surface 54 faces the intermediate gear 66 of the first gear system 55, the driving force from the feed motor 53 is not transmitted to the first gear 51. The second gear 52 is a partial gear having teeth over a predetermined angle "b", which may be 140 degrees. The second gear 52 also has a cylindrical or peripheral surface 52*a* with a diameter smaller than the outer diameter of this gear 52. When the peripheral surface 52*a* faces the second planet gear 68 of the second gear system 56, no driving force is transmitted from the feed motor 53 to the second gear 52. The leading edges 51L and 52L of the peripheral surfaces 54 and 52*a*, respectively, are aligned with each other.

At the initial position of the feed rollers 25, as shown in FIG. 1, their cylindrical surfaces 25*a* are away from the sheet support 12. When these rollers 25 are at the initial position, as also shown in FIG. 3, a leading edge portion of the peripheral surface 52*a* of the second gear 52 faces the second planet gear 68. This makes the driving force from the second gear system 56 unable to be transmitted to the second gear 52. The peripheral surface 54 of the first gear 51 has such a circumferential length (arc length) that, when the second planet gear 68 has returned the second gear 52 to the normal initial position, the first gear 51 and intermediate gear 66 are in mutual engagement. A sheet of paper P can be fed by the sheet feeder 2 and conveyed by the sheet conveyer 35 toward the print head 43 in the following way.

Figure 8:
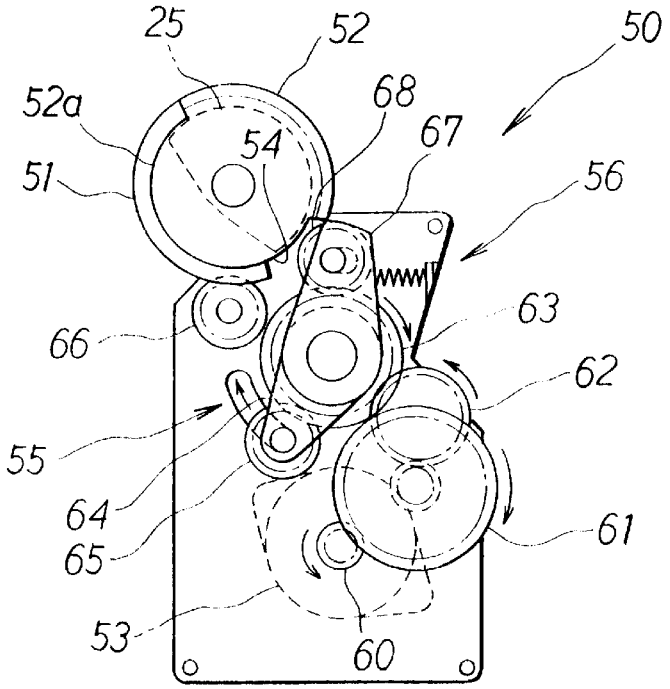
FIG. 8 is a side view of the drive in the initial position.
Figure 9:
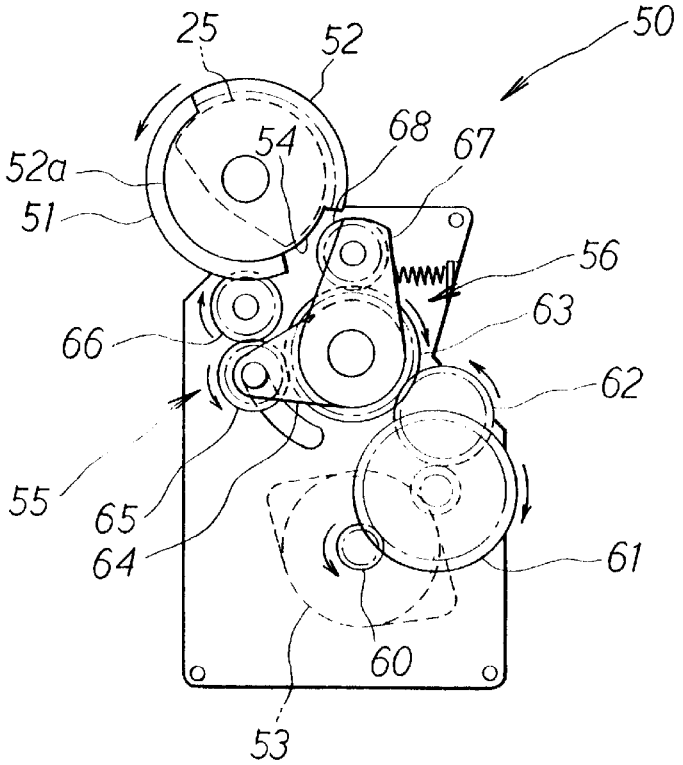
FIG. 9 is a side view of the drive with the feed motor rotating reversely.

When, as shown in FIG. 8, the feed motor 53 rotates reversely, the motor gear 60, reduction gear 61, feed gear 62 and sun gear 63 of the first gear system 55 rotate in the directions indicated by the arrows. The rotation of the sun gear 63 turns the first carrier arm 64 toward the intermediate gear 66 until, as shown in FIG. 9, the first planet gear 65 meshes with the intermediate gear 66. Thus, the reverse-rotation torque of the motor 53 is transmitted as the normal-rotation driving force to the first gear 51 through the first gear system 55. As a result, the feed rollers 25 start to turn normally together with the first gear 51. On the other hand, the feed gear 62 is rotating the feed roller 36 reversely.

Figure 10:
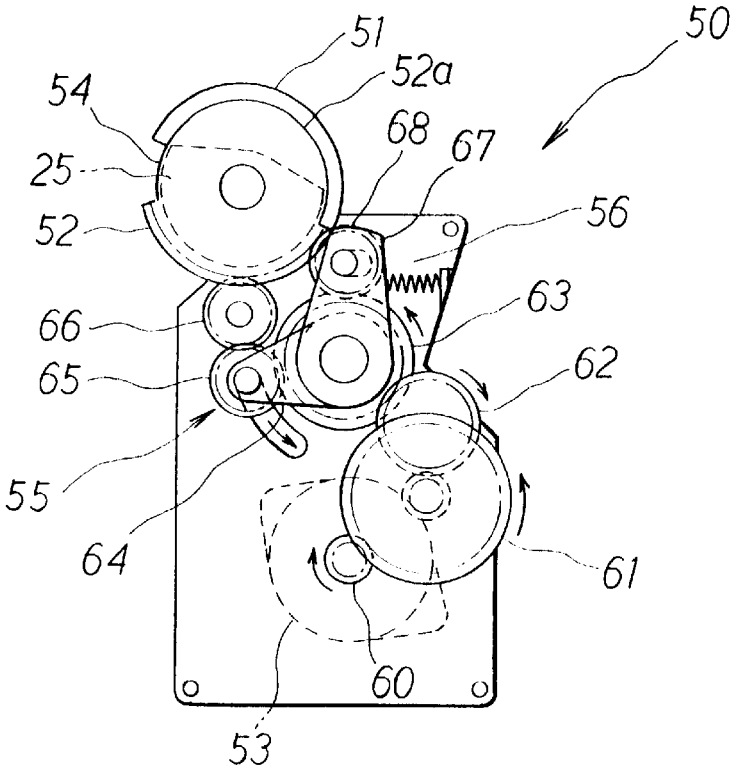
FIG. 10 is a side view of the drive with the feed motor being switched to rotate normally.

When the feed motor 53 has rotated reversely by the first predetermined amount, as shown in FIG. 10, the leading tooth of the second gear 52 comes into contact with the second planet gear 68. Because these gears 52 and 68 are rotating in the same direction, however, the second gear 52 repels and does not mesh with the second planet gear 68. During this step, although not shown, a sheet of paper P is fed by the feed rollers 25 toward the sheet conveyer 35. The front end of the fed sheet P comes into contact with and is registered between the reversely rotating feed roller 36 and pressure rollers 37. Thus, the sheet P is kept from moving downstream from the feed roller 36.

Figure 11:
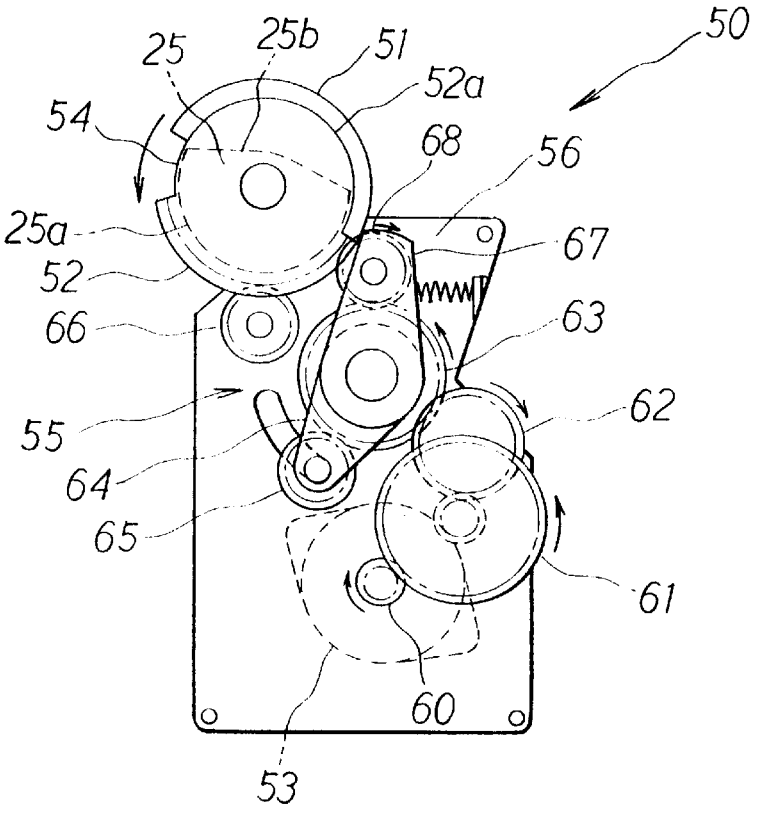
FIG. 11 is a side view of the drive with the feed motor rotating normally.

Then, when the feed motor 53 rotates normally, the motor gear 60, reduction gear 61, feed gear 62 and sun gear 63 rotate in the directions indicated in FIG. 10. The rotation of the sun gear 63 turns the first carrier arm 64 away from the intermediate gear 66. This, as shown in FIG. 11, disengages the first planet gear 65 from the intermediate gear 66. As a result, the first gear system 55 can transmit no driving force from the motor 53 to the first gear 51. On the other hand, the second planet gear 68 meshes with the second gear 52. As a result, the second gear system 56 transmits the torque of normal rotation of the motor 53 as the normal-rotation driving force to the second gear 52. Accordingly, the feed rollers 25 rotate normally together with the second gear 52. The feed gear 62 rotates the feed roller 36 normally.

When the feed motor 53 has rotated normally by the second predetermined amount, the leading edge portion of the peripheral surface 52*a* of the second gear 52 faces the second planet gear 68. As a result, this planet gear 68 disengages from the teeth of the second gear 52. This makes the driving force from the motor 53 unable to be transmitted through the second gear system 56 to the second gear 52. Consequently, the feed rollers 25 stop at their initial position shown in FIG. 8, while the feed roller 36 kept to rotate normally. As a result, with the cylindrical surfaces 25*a* of the feed rollers 25 away from the sheet P, only the feed roller 36 feeds it.

If something has caused the feed rollers 25 to move from their initial position, they can be returned to this position by the ordinary feeding operation in the following way.

If the feed motor 53 rotates reversely when, as shown in FIG. 11, the feed rollers 25 are stopping with their cylindrical surfaces 25*a* facing the sheet support 12, the first gear system 55 rotates these rollers 25 normally. If the first gear 51 had no cylindrical or peripheral surface 54, it would be rotated by about 150 degrees when the motor 53 has rotated reversely by the first predetermined amount. Consequently, the second planet gear 68 would face the peripheral surface 52*a* of the second gear 52. As a result, when the motor 53 then rotates normally, its driving force would not be transmitted through the second gear system 56 to the second gear 52. This would keep the feed rollers 25 stopping and from returning to their initial position.

Figure 12:
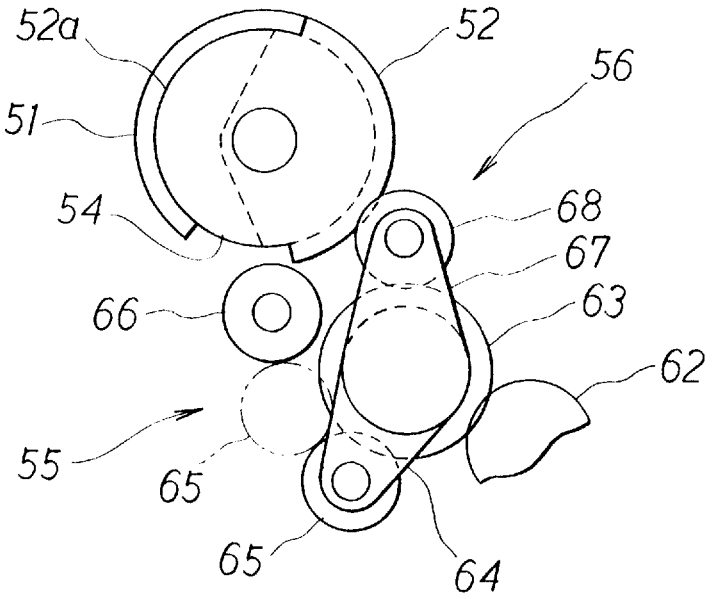
FIG. 12 is an enlarged partial view of the drive with the first gear disengaged from the intermediate gear when the feed roller begins to rotate from a position which is different from the initial position.

In accordance with the embodiment, as shown in FIG. 12, the peripheral surface 54 of the first gear 51 faces the intermediate gear 66 while the feed motor 53 is rotating reversely by the first predetermined amount. As a result, no driving force is transmitted through the first gear system 55 to the first gear 51. Accordingly, the feed rollers 25 stop rotating.

At this stage, the second planet gear 68 is in mesh with the second gear 52. When the feed motor 53 has subsequently rotated normally by the second predetermined amount, the second planet gear 68 faces the peripheral surface 52*a* of the second gear 52. This stops the second gear 52. In other words, the second gear 52 returns to its initial position shown in FIG. 8. The sheet of paper which is fed by this turn of the feed rollers 25 has come in contact with these rollers 25 from their mid position. As a result, the feed is not sufficient, so that the sheet is fed defectively. The next sheet can, however, be fed regularly or ordinarily.

In short, the peripheral surface 54 of the first gear 51 makes the normal-rotation driving force unable to be transmitted through the first gear system 55 to the first gear 51. This surface 54 is formed in such a position that it does not face the first gear system 55 while the first gear 51 is rotated normally from its initial position by the reverse rotation of the feed motor 53 by the first amount, but it faces the first system 55 when the first gear 51 is rotated from another position than the initial position by the reverse rotation of the motor 53, and it can return to its initial position while the second gear 52 is rotated normally by the second amount. Accordingly, as stated above, by carrying out the feeding operation once, it is possible to return the feed rollers 25 at any angular position securely to their initial position.

Figure 13:
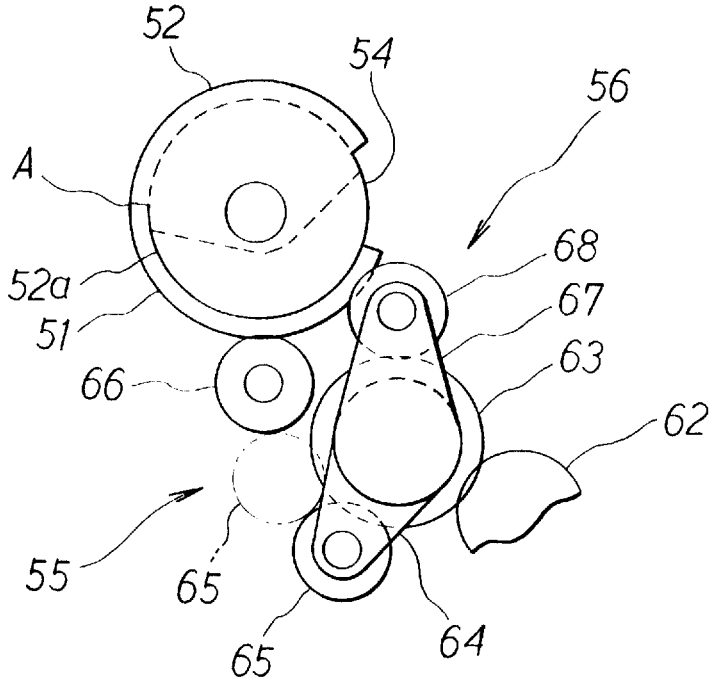
FIG. 13 is an enlarged partial view of the drive with the first gear meshing with the intermediate gear when the feed roller begins to rotate from a position which is different from the initial position.
Figure 14:
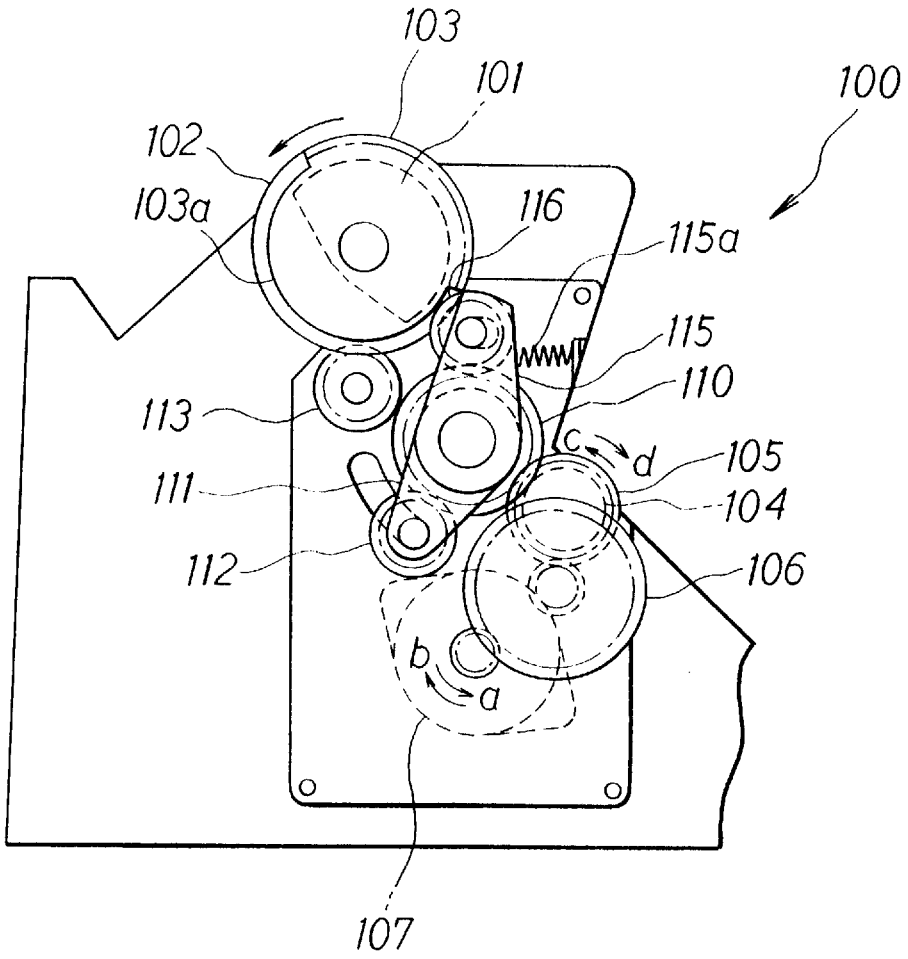
FIG. 14 is a side view of a drive of a prior art printer.
Figure 15:
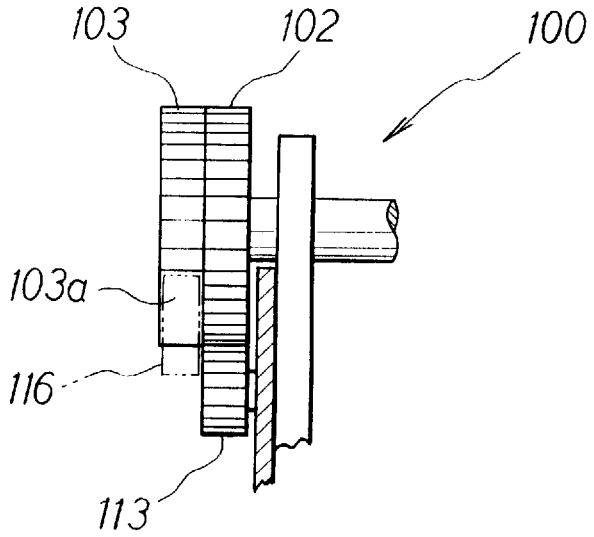
FIG. 15 is a partial view of the drive shown in FIG. 13.
Figure 16:
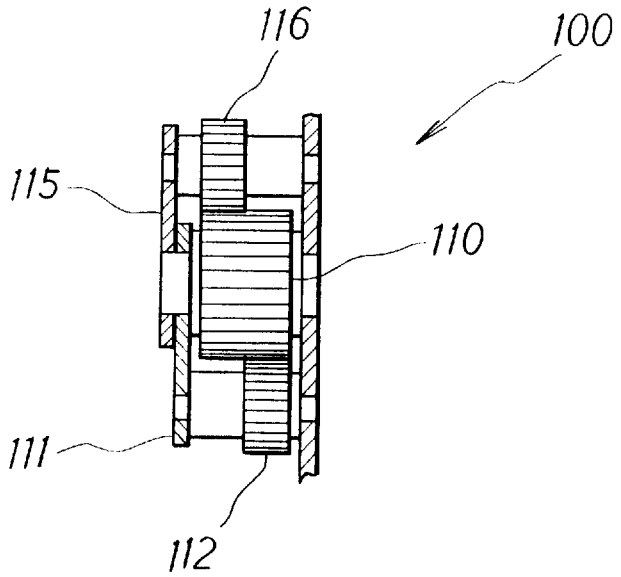
FIG. 16 is another partial view of the drive shown in FIG. 13.

If, as shown in FIG. 13, the feed rollers 25 are stopping at a position a little forward in the direction of normal rotation from their initial position, the first gear 51 is rotated by about 150 degrees when the feed motor 53 has rotated by the first amount. This causes the point A on the second gear 52 to face the second planet gear 68. Consequently, while the motor 53 is rotating subsequently in the normal direction by the second amount, the second planet gear 68 rotates the second gear 52 normally. When this planet gear 68 faces the peripheral surface 52*a,* the second gear 52 stops. Consequently, the feed rollers 25 return to their initial position shown in FIG. 8. In short, if the second gear 52 is in mesh with the second planet gear 68 when the motor 53 has rotated by the first amount, the peripheral surface 54 of the first gear 51 does not face the intermediate gear 66, but the normal rotation of the second gear 52 can return the feed rollers 25 to their initial position.

The first gear system 55 can be a simple mechanism, which includes the sun gear 63, first carrier arm 64, first planet gear 65 and intermediate gear 66. The second gear system 56 can be another simple mechanism, which includes the sun gear 63, second carrier arm 67 and second planet gear 68. This is very advantageous in terms of production costs.

The circumferential length of the peripheral surface 54 of the first gear 51 is so set that, when the second planet gear 68 has returned the second gear 52 to the normal initial position, the first gear 51 and intermediate gear 66 can be in mesh securely with each other. Therefore, in the next feeding operation, the reverse-rotation torque of the feed motor 53 can be transmitted securely as the normal-rotation driving force through the first gear system 55 to the first gear 51.

The second gear 52 is a partial gear, to which no driving force can be transmitted through the second gear system 56 when this gear 52 has returned to the normal initial position. While the feed motor 53 is rotating normally by the second amount, no driving force can be transmitted from the second gear system 56 when the second planet gear 68 and second gear 52 are disengaged from each other. This can securely stop the feed rollers 25 at their initial position.

What is claimed is:

1. A sheet feeder comprising:

a sheet support for supporting sheets of paper;

a semi-cylindrical feed roller for feeding a sheet of paper by turning with the cylindrical surface of the roller in contact with the top one of the sheets of paper stacked on the sheet support;

a first gear fixed to an end of the feed roller;

a second gear fixed to an end of the feed roller;

a feed motor which can rotate in both directions to drive the first and second gears;

a first gear system for transmitting the torque of reverse rotation of the feed motor as normal driving force to the first gear;

a second gear system for transmitting the torque of normal rotation of the feed motor as normal driving force to the second gear; and a controller for controlling the feed motor so as to rotate the motor reversely by a predetermined amount of reverse rotation and, thereafter, normally by a predetermined amount of normal rotation when the feed roller feeds a sheet of paper;

the first gear having a peripheral surface without teeth, the surface being formed in at least part of a different peripheral portion of the first gear than the peripheral portion of the first gear which engages with the first gear system while the reverse rotation of the feed motor by the predetermined amount of reverse rotation is turning the feed roller by a first predetermined amount from an initial position.

2. The sheet feeder of claim 1, wherein the controller controls the feed motor in such a manner that the reverse rotation of the motor by the predetermined amount of reverse rotation turns through the first gear the feed roller by the first predetermined amount from the initial position and, thereafter, the normal rotation of the motor by the predetermined amount of normal rotation turns through the second gear the feed roller by a second predetermined amount, thereby feeding a sheet of paper.

3. The sheet feeder of claim 1, wherein even if the feed roller has started to turn from another position than the initial position, the peripheral surface of the first gear makes it possible to return the roller to the initial position after the feed motor rotates reversely and normally.

4. The sheet feeder of claim 3, wherein if the feed roller has started to turn from another position than the initial position, the roller can, after the reverse and normal rotations of the feed motor, be returned to the initial position by the peripheral surface of the first gear facing the first gear system when the motor rotates reversely by the predetermined amount of reverse rotation.

5. The sheet feeder of claim 3, wherein the second gear has a peripheral surface without teeth, the surface being formed in the peripheral portion of the second gear which faces the second gear system when the feed roller is in the initial position.

6. The sheet feeder of claim 3, wherein the second gear has a peripheral surface without teeth, the surface being formed over the peripheral portion of the second gear which faces the second gear system while the feed roller is turning by the first predetermined amount from the initial position.

7. The sheet feeder of claim 5, wherein if the feed roller has started to turn from another position than the initial position, the peripheral surface of the first gear does not face the first gear system while the feed motor is rotating reversely by the predetermined amount of reverse rotation, but the roller can be returned to the initial position by the peripheral surface of the second gear facing the second gear system while the motor is rotating normally by the predetermined amount of normal rotation.

8. The sheet feeder of claim 5, wherein the peripheral surfaces of the first and second gears have such positional relationship to each other that teeth which can engage with the first or second gear system always exist in at least one of the peripheral portions of the first and second gears which face the first and second gear systems, respectively.

9. The sheet feeder of claim 6, wherein the leading edges of the peripheral surfaces of the first and second gears are aligned axially with each other.

10. The sheet feeder of claim 1, wherein:

the first gear system includes a sun gear, a first arm supported pivotably on the axis coaxial with the sun gear, the first arm being able to be turned in the same direction as the sun gear rotates, a first planet gear supported rotatably on the free end of the first arm, the first planet gear meshing with the sun gear, and an intermediate gear which can mesh with the first gear and the first planet gear; and the second gear system includes the sun gear, a second arm supported pivotably on the axis coaxial with the sun gear, the second arm being able to be turned in the same direction as the sun gear rotates, and a second planet gear supported rotatably on the free end of the second arm, the second planet gear meshing with the sun gear, the second planet gear being able to mesh with the second gear.

11. The sheet feeder of claim 6, further comprising a second feed roller rotatable in the direction according to the direction of rotation of the feed motor, the reverse rotation of the second feed roller registering the front end of the sheet fed by the semi-cylindrical feed roller, the normal rotation of the second feed roller conveying the sheet fed by the semi-cylindrical feed roller.

12. The sheet feeder of claim 1, wherein the cylindrical surface of the feed roller is away from the sheet feeder when the roller is at the initial position.

13. A printer comprising:

a sheet feeder and;

a print head for printing a sheet of paper, the feeder including:

a sheet support for supporting sheets of paper;

a semi-cylindrical feed roller for feeding a sheet of paper by turning with the cylindrical surface of the roller in contact with the top one of the sheets of paper stacked on the sheet support;

a first gear fixed to an end of the feed roller;

a second gear fixed to an end of the feed roller;

a feed motor which can rotate in both directions to drive the first and second gears;

a first gear system for transmitting the torque of reverse rotation of the feed motor as normal driving force to the first gear;

a second gear system for transmitting the torque of normal rotation of the feed motor as normal driving force to the second gear; and a controller for controlling the feed motor so as to rotate the motor reversely by a predetermined amount of reverse rotation and, thereafter, normally by a predetermined amount of normal rotation when the feed roller feeds a sheet of paper;

the first gear having a peripheral surface without teeth, the surface being formed in at least part of a different peripheral portion of the first gear than the peripheral portion of the first gear which engages with the first gear system while the reverse rotation of the feed motor by the predetermined amount of reverse rotation is turning the feed roller by a first predetermined amount from an initial position.

14. The printer of claim 13, wherein the controller controls the feed motor in such a manner that the reverse rotation of the motor by the predetermined amount of reverse rotation turns through the first gear the feed roller by the first predetermined amount from the initial position and, thereafter, the normal rotation of the motor by the predetermined amount of normal rotation turns through the second gear the feed roller by a second predetermined amount, thereby feeding a sheet of paper.

15. The printer of claim 13, wherein even if the feed roller has started to turn from another position than the initial position, the peripheral surface of the first gear makes it possible to return the roller to the initial position after the feed motor rotates reversely and normally.

16. The printer of claim 15, wherein if the feed roller has started to turn from another position than the initial position, the roller can, after the reverse and normal rotations of the feed motor, be returned to the initial position by the peripheral surface of the first gear facing the first gear system when the motor rotates reversely by the predetermined amount of reverse rotation.

17. The printer of claim 15, wherein the second gear has a peripheral surface without teeth, the surface being formed in the peripheral portion of the second gear which faces the second gear system when the feed roller is in the initial position.

18. The printer of claim 15, wherein the second gear has a peripheral surface without teeth, the surface being formed over the peripheral portion of the second gear which faces the second gear system while the feed roller is turning by the first predetermined amount from the initial position.

19. The printer of claim 17, wherein if the feed roller has started to turn from another position than the initial position, the peripheral surface of the first gear does not face the first gear system while the feed motor is rotating reversely by the predetermined amount of reverse rotation, but the roller can be returned to the initial position by the peripheral surface of the second gear facing the second gear system while the motor is rotating normally by the predetermined amount of normal rotation.

20. The printer of claim 17, wherein the peripheral surfaces of the first and second gears have such positional relationship to each other that teeth which can engage with the first or second gear system always exist in at least one of the peripheral portions of the first and second gears which face the first and second gear systems, respectively.

21. The printer of claim 18, wherein the leading edges of the peripheral surfaces of the first and second gears are aligned axially with each other.

22. The printer of claim 13, wherein:

the first gear system includes a sun gear, a first arm supported pivotably on the axis coaxial with the sun gear, the first arm being able to be turned in the same direction as the sun gear rotates, a first planet gear supported rotatably on the free end of the first arm, the first planet gear meshing with the sun gear, and an intermediate gear which can mesh with the first gear and the first planet gear; and the second gear system includes the sun gear, a second arm supported pivotably on the axis coaxial with the sun gear, the second arm being able to be turned in the same direction as the sun gear rotates, and a second planet gear supported rotatably on the free end of the second arm, the second planet gear meshing with the sun gear, the second planet gear being able to mesh with the second gear.

23. The printer of claim 18, further comprising a second feed roller rotatable in the direction according to the direction of rotation of the feed motor, the reverse rotation of the second feed roller registering the front end of the sheet fed by the semi-cylindrical feed roller, the normal rotation of the second feed roller conveying the sheet fed by the semi-cylindrical feed roller.

24. The printer of claim 13, wherein the cylindrical surface of the feed roller is away from the sheet feeder when the roller is at the initial position.

25. The printer of claim 13, wherein the print head is an ink jet head.

* * * * *